United States Patent [19]

Kiraly et al.

[11] 4,403,414

[45] Sep. 13, 1983

[54] SOCKET DEVICE FOR A PIVOTAL RAZOR

[75] Inventors: Ernest F. Kiraly, Fairfield; Ernest A. Ortiz, Cheshire, both of Conn.

[73] Assignee: Warner-Lambert Company, Morris Plains, N.J.

[21] Appl. No.: 252,638

[22] Filed: Apr. 9, 1981

[51] Int. Cl.[3] ..... B26B 19/00; B26B 21/00

[52] U.S. Cl. ..... 30/57; 30/58; 30/87

[58] Field of Search ..... 30/57, 50, 47, 87, 89, 30/58, 59, 60.5

[56] References Cited

U.S. PATENT DOCUMENTS

| | | | |
|---|---|---|---|
| 3,541,683 | 11/1970 | Iten | 30/60.5 |
| 3,935,639 | 2/1976 | Terry et al. | 30/87 X |
| 4,198,746 | 4/1980 | Trotta | 30/47 |
| 4,288,920 | 9/1981 | Douglass et al. | 30/47 |

*Primary Examiner*—James G. Smith
*Assistant Examiner*—Willmon Fridie, Jr.
*Attorney, Agent, or Firm*—R. S. Strickler

[57] ABSTRACT

A socket device for making a pivotal connection between a single or multiple blade cartridge and a support where a connection between the socket and the support is accomplished by interlocking arcuate flanges and a connection between the socket and a cartridge is formed by cooperation between a channel and a track.

13 Claims, 17 Drawing Figures

FIG. 2
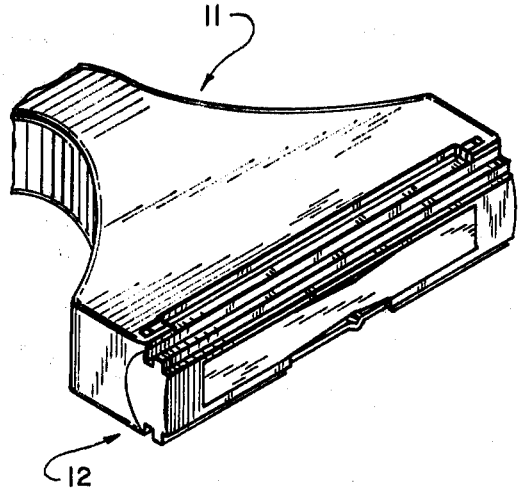
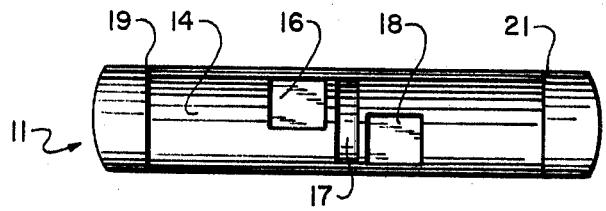
FIG. 3A
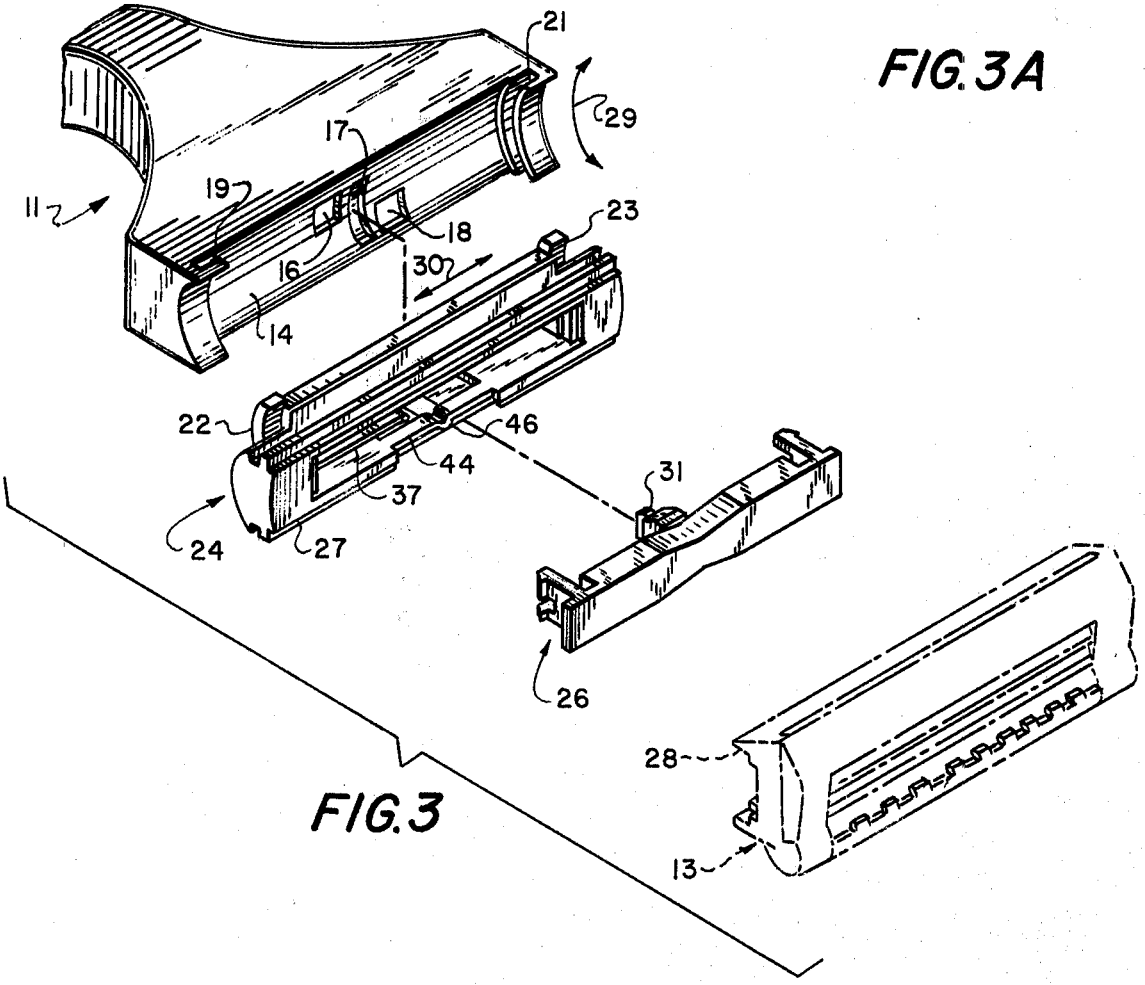
FIG. 3

SOCKET DEVICE FOR A PIVOTAL RAZOR

BACKGROUND OF THE INVENTION

The present invention relates to pivotal razors of the type in which a blade cartridge is carried by a support by means of cooperating or interlocking arcuate flanges. Usually the blade cartridge is connected to the support through an intermediate member termed a "socket" in this specification.

The socket serves as a connector between the support and the blade cartridge in that one side of the socket is formed with a track operable to make a sliding connection with a channel formed on the cartridge in well-known fashion. The opposite side of the socket is formed with an arcuate flange which makes a pivotal and interlocking connection with a mating flange formed on the support.

Pertinent and representative embodiments of this basic connecting structure and method are disclosed and described in U.S. Pat. No. 3,935,639 issued Feb. 3, 1976, to Terry et al., and in U.S. Pat. No. 3,938,247 issued Feb. 17, 1976, to Carbonell et al., both assigned on the face of each patent to The Gillette Company of Boston, Mass.

The '639 patent is most pertinent to the present invention.

This patent shows (see FIG. 1) a socket 16 supporting a blade cartridge 12 by the classical interlocking channel and track arrangement on one side and making a pivotal connection to a support 14 on the opposite side by means of interlocking arcuate flanges indicated by the reference numeral 40.

The '247 patent shows a manually operable lever for selecting the arc through which the socket pivots.

The present invention is an improvement over the disclosures of the above patents, and the novelty of the invention arises from the structure of the socket, socket support, and the socket track and the cooperation between the socket and the socket support.

Therefore it is a particular feature of the invention to provide an all-plastic socket fabricated from a minimum number of piece-parts consistent with ease and economy of manufacture, and facility of assembly on a mass production basis.

It is a further feature of the invention to provide novel structure for control of the pivotal and axial motion of the socket relative to its support.

A further feature of the invention is the provision of a novel spring arrangement to power "recovery" or return of the blade cartridge to its neutral or normal position.

A further feature of the invention is the provision of a track structure on the socket which includes means for latching the cartridge to the socket where the track latching means is cast integrally with the track to define with the track a unitary piece-part.

A further feature of the invention is the provision of a single, centrally located thrust bearing involving the socket and its support which functions dually to limit (1) axial motion and (2) pivotal arc or angular rotation from said neutral position.

SUMMARY OF THE INVENTION

A representative embodiment of the present invention may comprise a single or multiple blade cartridge carried by a socket by means of a channel-track connection where the socket is, in turn, mounted movably in a support by means of interlocking, arcuate flanges, the socket being pivotal through an arc on either side of a neutral position about an axis parallel to a blade and the socket is slidable, to and fro, through a stroke and along a path parallel to said axis, a plurality of pockets formed in said support, each pocket having a bearing surface, a thrust bearing element projecting from said socket and cooperating with the bearing surface of a first pocket to limit said stroke and said arc and spring means carried by said socket operable to engage second and third pockets to bias said socket toward said neutral position.

Other features and advantages of the invention will become more apparent from an examination of the following specification when read in conjunction with the appended drawings, in which;

BRIEF DESCRIPTION OF THE DRAWINGS

FIG. 2 is a view similar to FIG. 1 showing the socket attached to its support but with the blade cartridge removed;

FIG. 3 is an exploded view of FIG. 1 showing all elements, namely, support, socket body, socket cap and blade cartridge in phantom;

FIG. 3A is an enlarged view of the top portion of the support;

DESCRIPTION OF PREFERRED EMBODIMENT

Figure 1:
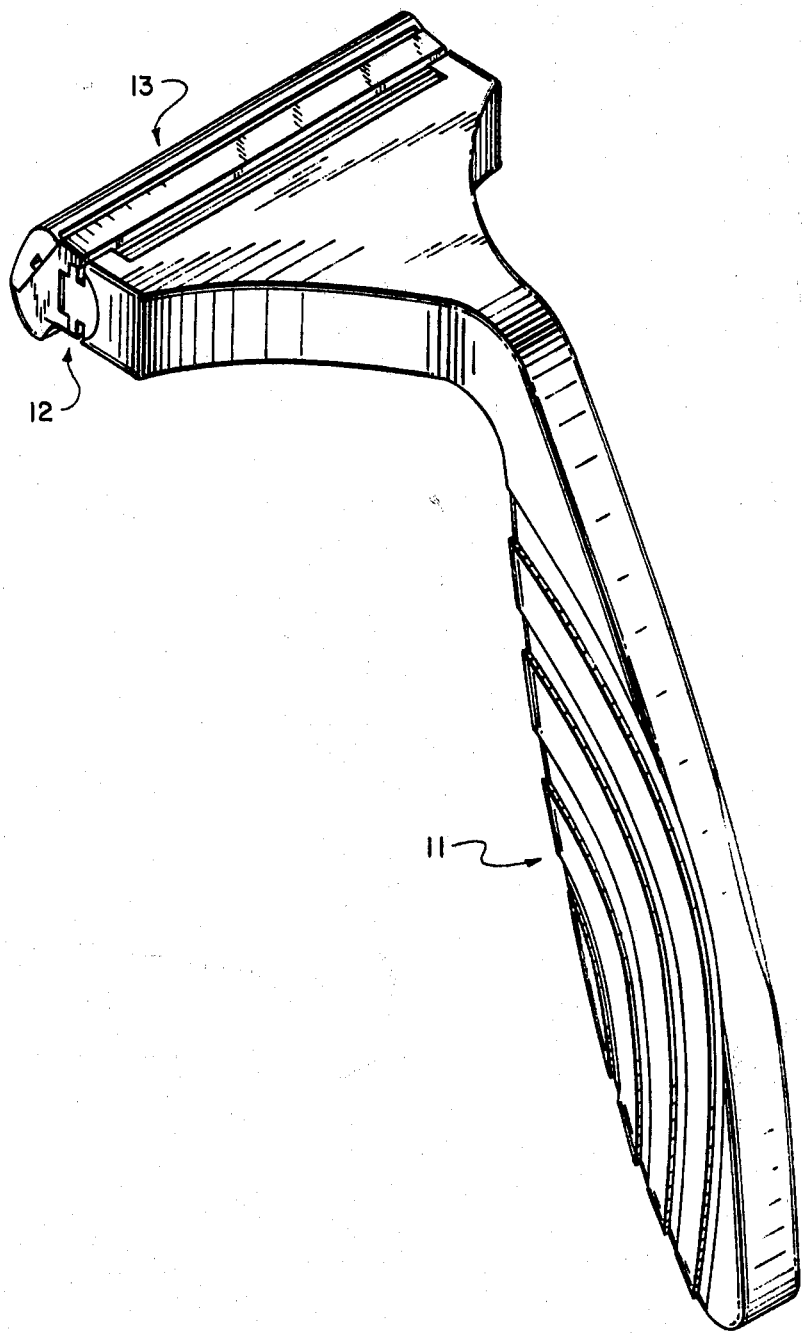
FIG. 1 is a perspective view of an assembled razor including support, socket and blade cartridge.

Referring now in detail to the drawings, in particular, FIGS. 1, 2 and 3, the basic components of the pivotal razor embracing the principles of the present invention are a handle or support 11, socket 12 and blade cartridge 13.

FIG. 2 shows the socket 12 assembled to the support 11 and FIG. 3 shows that the socket 12 is composed of two piece-parts, namely, a socket body 24 and a socket cap 26. It is also apparent that the socket body 24 is formed with a track 27 which engages a mating channel 28 formed in the blade cartridge 13 operable to connect the cartridge to the socket in well-known fashion.

The structure of the blade cartridge can be of the one or two-blade variety and its overall design is not critical to the principles of the invention so long as the cartridge 13 makes a suitable connection with the socket 12.

In FIGS. 3 and 3A, it is further apparent that the support 11 has an arcuate or curved face 14 which is formed with pockets 16, 17 and 18 whose utility will become apparent as the specification proceeds.

The curved face 14 is formed at each end with arcuate flanges or tracks 19 and 21 which mate with or interlock with cooperating flanges 22 and 23 formed on the socket body to effect a pivotal or rocking connection of the type disclosed and claimed in said '639.

It is to be noted that socket body 24, as a single piece-part (without its mating socket cap 26), is constructed so that, while making a pivotal or rocking connection with the support 11 by virtue of the action of the interlocking flanges, is free to rotate into and out of engagement with the support 11 in either rotational direction as indicated by the arrows labeled 29 in FIG. 3.

Note further that the mating flanges 19 and 22 on the left and mating flanges 21 and 23 on the right are dimensioned so that there is appreciable clearance affording relative motion laterally between the socket body 24 and the support 11 along a path parallel to the arrows identified by the reference numeral 30.

The structure and operation of the means for controlling rotational and lateral motion of the socket body 24 and thus the socket 12 relative to the support 11 will become apparent as this specification proceeds.

Figure 4:
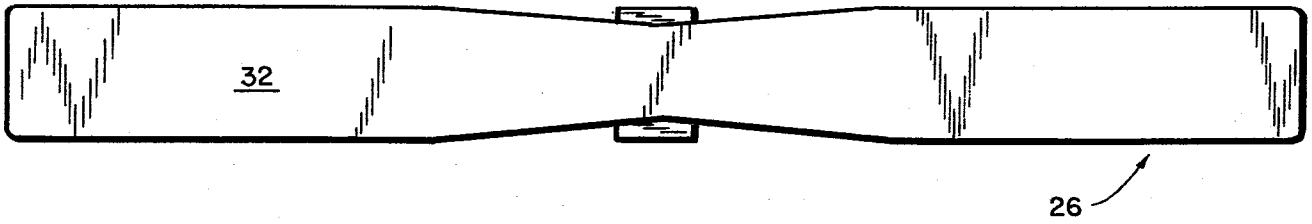
FIG. 4 is a plan view of the socket cap.
Figure 5:
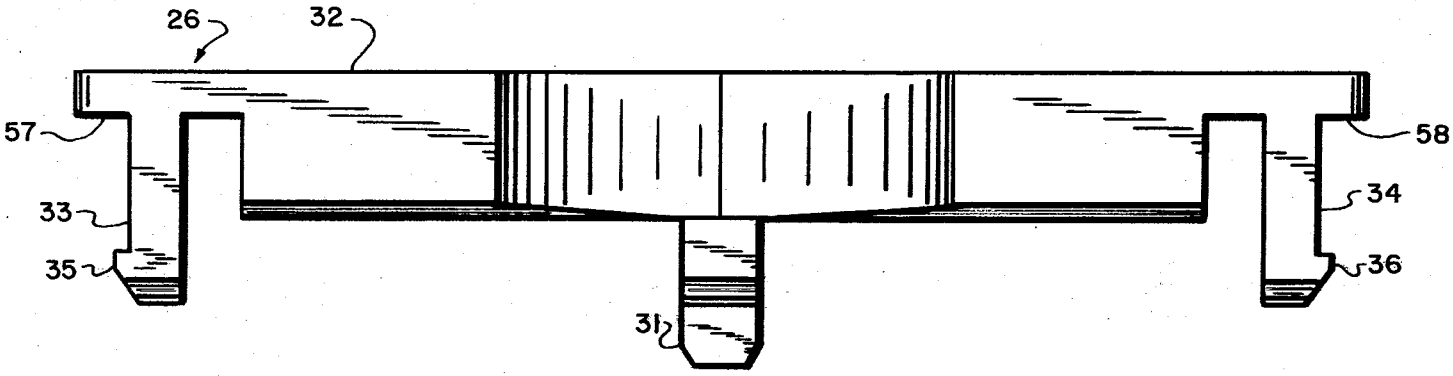
FIG. 5 is a side elevation of the socket cap.

Referring to FIGS. 4 and 5, note that the socket cap 26 includes an elongated body 32 having a centrally located thrust bearing element 31 and is formed at each end with flexible fingers 33 and 34 each terminating in a claw 35 and 36 operable to make a permanent connection with mating elements of the socket body 24.

Figure 6:
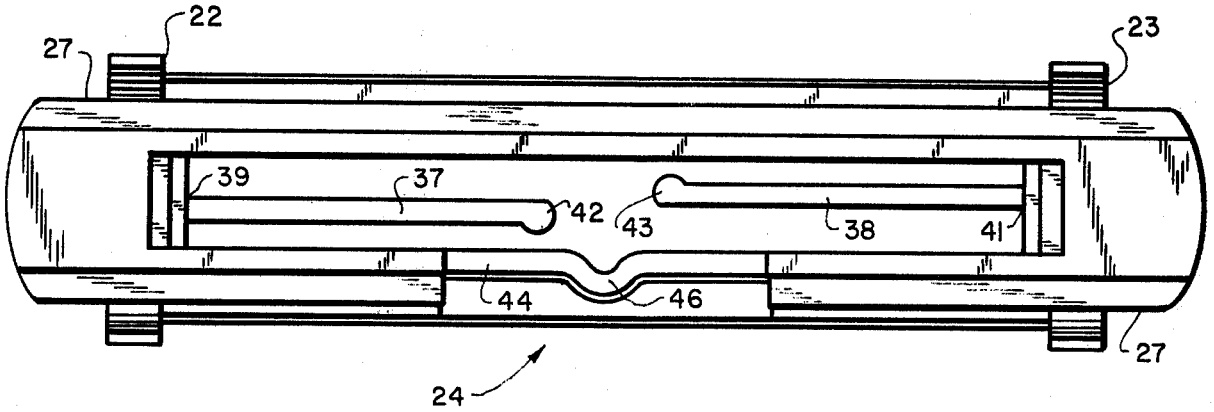
FIG. 6 is a plan view of the socket body.
Figure 7:
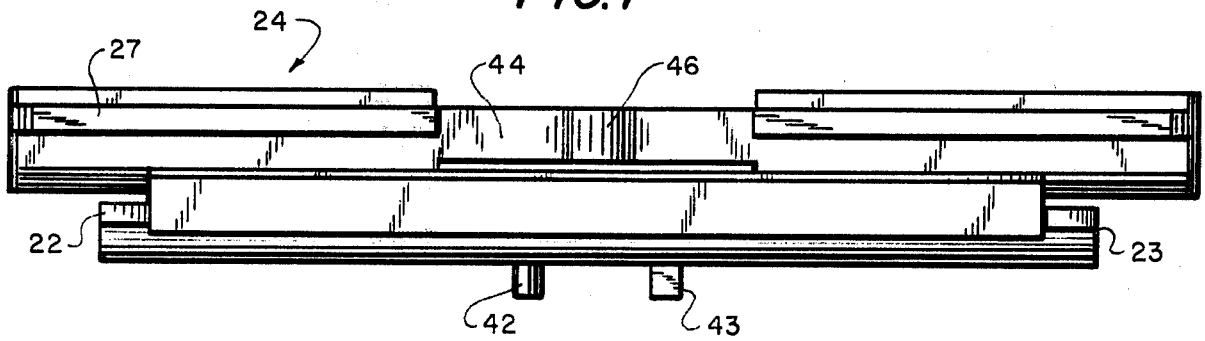
FIG. 7 is a side elevation of the socket body.
Figure 8:
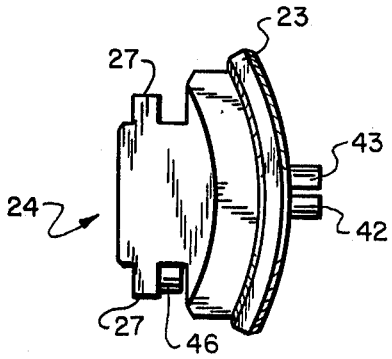
FIG. 8 is an end elevation of FIG. 7 as viewed from the right side of FIG. 7.

FIGS. 6, 7 and 8 show that the socket body, formed with a track 27, carries a pair of elongated, opposed leaf springs 37 and 38 each anchored to the socket body as at 39 and 41 and each terminating at a free end in an operating pin 42 and 43.

A portion of the track 27 defines a flexible web 44 supporting a button or protuberance 46 molded or cast integrally with the socket body 24 so that the body 24 as illustrated in FIGS. 6, 7 and 8 defines a single piece-part.

The button 46 is received in a mating recess (not shown) formed in the channel 28 of the blade cartridge for positioning the cartridge centrally relative to the support 11.

Figure 10:
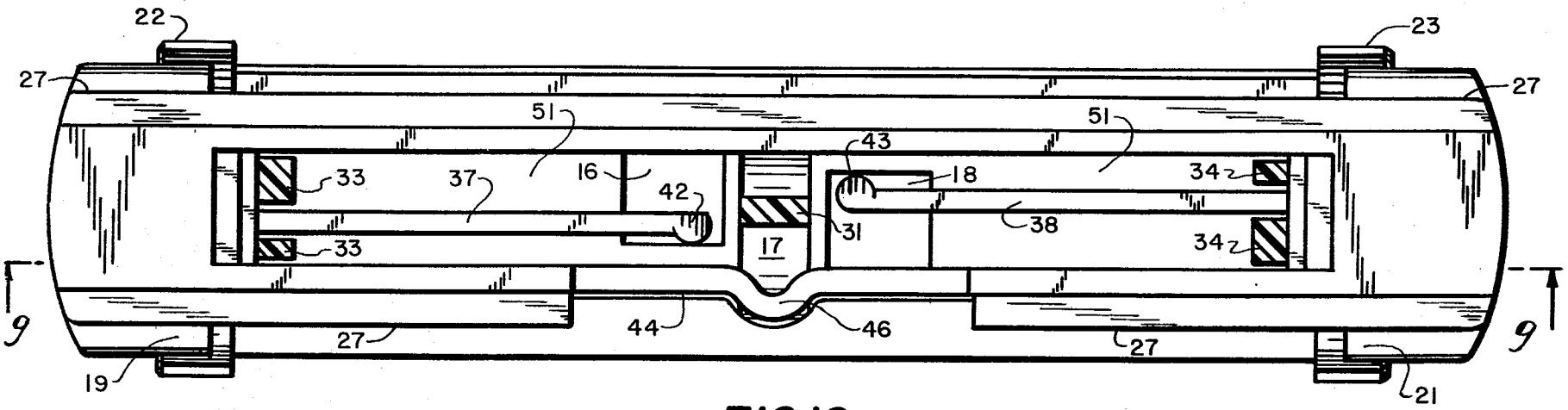
FIG. 10 is a top plan view of FIG. 9 with portions broken away for clarity.
Figure 9:
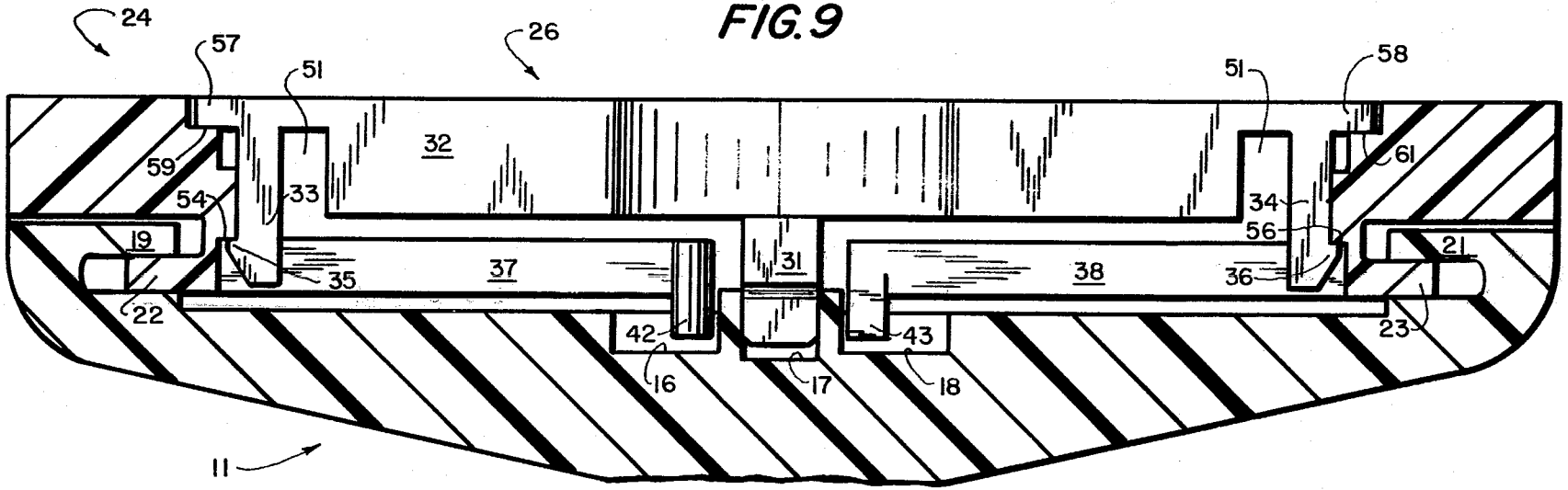
FIG. 9 is an elevational view, partially in section, showing the assembled socket cap and socket body mounted in the support.

A reference to FIGS. 9 and 10 reveals in greater detail the relationship between the assembled socket 12 and the support 11.

Note that arcuate flanges 19 and 22 interlock on the left while flanges 21 and 23 interlock on the right to connect the socket body to the support 11.

The socket cap 26 makes a connection with the socket body 24 in that it is received within the opening 51 formed in the body and flexible fingers 33-33 and 34-34 straddle mating leaf springs 37 and 38 respectively.

Note that although two flexible fingers 33-33 on the left and two fingers 34-34 on the right are shown, it is entirely within the scope of the invention to use a single finger on each side.

As the socket cap is inserted into the body, fingers 33-33 and 34-34 flex inwardly as they slide along walls 52 and 53 until claws reach the bottom of the respective walls whereupon claws 35 and 36 snap inwardly making a latching connection on shoulders 54 and 56.

Entry of the cap 26 into the body 24 is limited by the engagement of lips 57 and 58 of the cap with offsets 59 and 61 of the body.

Note that socket body 24 is positioned relative to support (see FIG. 9) so that operating pins 42 and 43 of leaf springs 37 and 38 are received in pockets 16 and 18 respectively. Correspondingly, thrust bearing element 31 is received in center pocket 17 and operates dually to control or limit axial motion and pivotal arc.

The socket device of the present invention operates in the following fashion in response to forces generated during the act of wet shaving:

OPERATION

Figure 11:
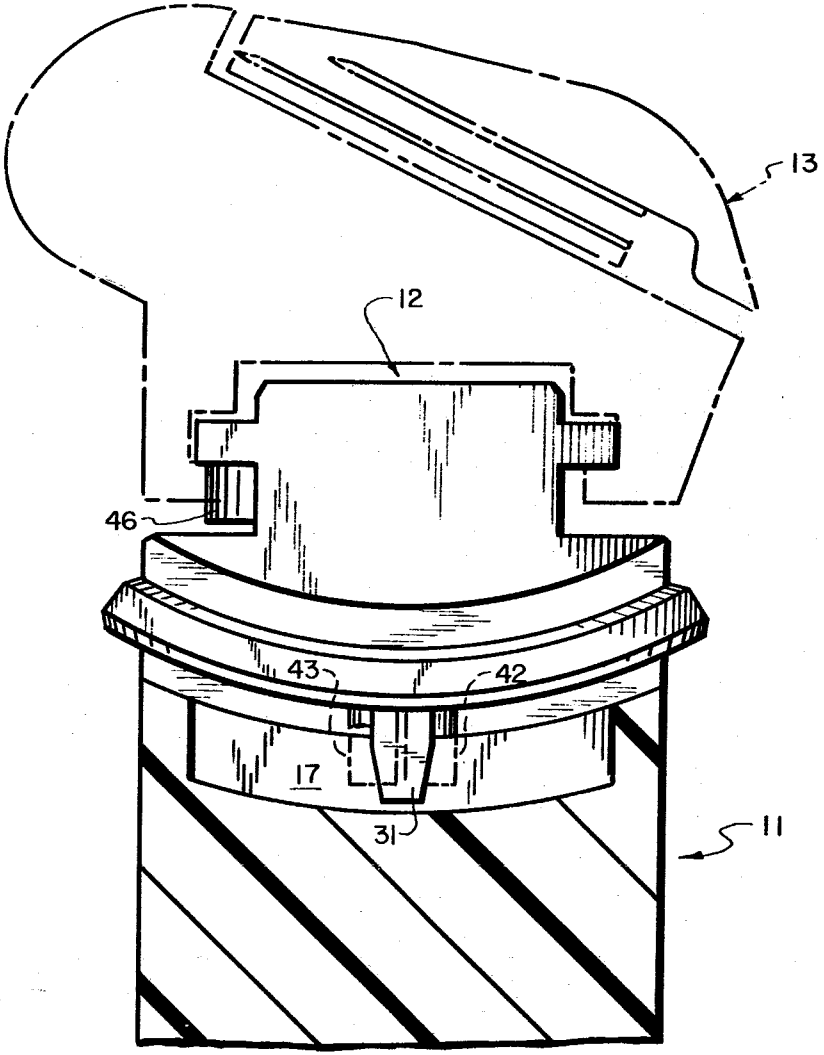
FIG. 11 is an end view of FIG. 10 as viewed from the right side with portions broken away to show disposition of spring and thrust bearing elements when the socket and blade cartridge are in the neutral position.

Assume that the blade cartridge socket and support are in the neutral position as shown in FIG. 11. Assume further that one is observing the razor of FIG. 1 from the left side of FIG. 1.

Figure 11A:
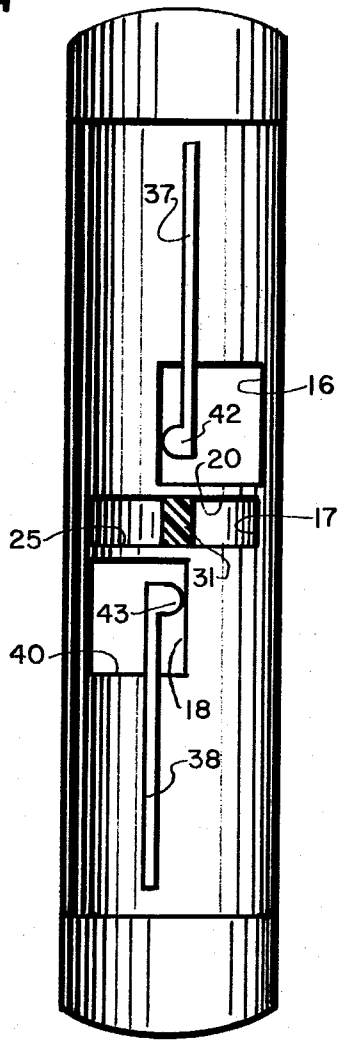
FIG. 11A shows the disposition of the spring and thrust bearing elements relative to one another and relative to the support pockets when in the neutral position.

FIG. 11A shows the disposition of the springs 37 and 38 and the thrust bearing element 31 relative to one another and to the cooperating pockets 16, 17 and 18 when in the neutral position. Thrust bearing element 31 is in a thrust bearing relationship with bearing surfaces 20 and 25 of pocket 17 preventing lateral motion of the socket parallel to the path indicated by the arrows 30. The bearing element 31 is located centrally in pocket 17 indicating that there is no pivoting of the socket 12 relative to the support 11. This position defines the neutral position.

Note further that springs 37 and 38 are generally parallel with their respective operating pins 42 and 43 in contact snugly with bearing surfaces 35 and 40 of pockets 16 and 18 respectively.

Figure 12:
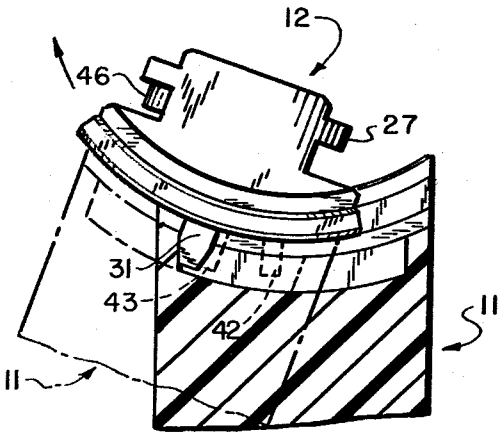
FIGS. 12 and 12A are similar to FIGS. 11 and 11A and show the socket and blade cartridge rotated clockwise to the extreme pivoted position to the right.
Figure 12A:
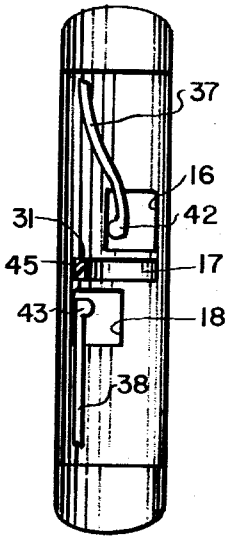

When shaving forces cause the blade cartridge and socket to rotate clockwise to the extreme right relative to the support 11, the disposition of the cartridge and socket are as illustrated in FIGS. 12 and 12A. In this condition, bearing element 31 is at the left end of pocket 17 as indicated by the reference numeral 45, spring 37 is under tension in that its operating pin 42 in pocket 16 (against the left side of its bearing surface) causes the spring 37 to deflect. The spring 38 and its operating pin 43 are free to sweep across pocket 18 from the position shown in FIG. 11A to the position illustrated in FIG. 12A. The tension of spring 37 urges the blade cartridge and socket toward the neutral position and when shaving forces are released moves the blade cartridge to the neutral position.

Figure 13:
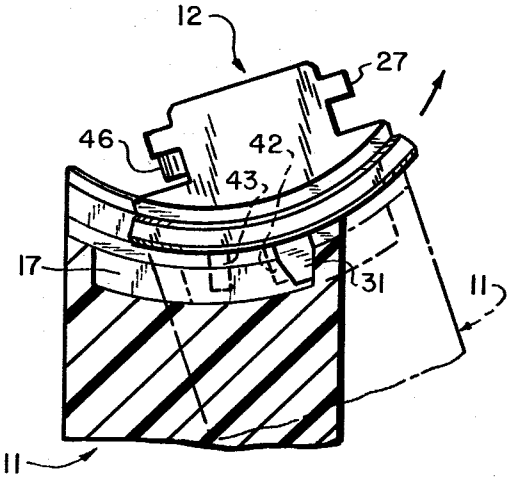
FIGS. 13 and 13A show the situation when the socket and blade cartridge are rotated counterclockwise to the extreme pivoted position to the left.
Figure 13A:
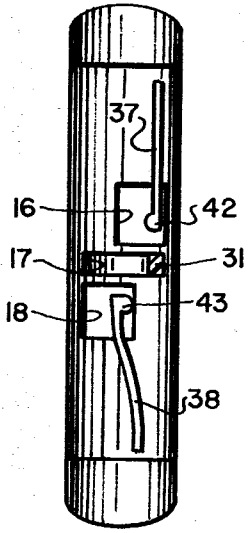

Correspondingly, when shaving forces cause counterclockwise rotation to the extreme left, the respective components assume the positions illustrated in FIGS. 13 and 13A. That is, thrust bearing element 31 is at the right side of pocket 17, spring 38 is under tension, and spring 37 is free. The tension of spring 38 urges the blade cartridge and socket toward the neutral position and upon release of shaving forces returns the cartridge to the neutral position from its counterclockwise rotational position.

It is anticipated that a wide variety of embodiments of the present invention may be devised without departing from the spirit and scope of the present invention.

What is claimed is:

1. In a razor including a single or multiple blade cartridge of the type carried by a socket mounted movably in a support by means of interlocking arcuate flanges, said socket being pivotal through an arc on opposite sides of a neutral position about an axis parallel to a blade and slidable to and fro through a stroke along a path parallel to said axis, the improvement comprising:

a plurality of pockets formed in said support, said pockets being disposed along a line generally corresponding to the pivot side of the socket, each pocket having a bearing surface, a thrust bearing element projecting from said socket and cooperating with the bearing surface and said arc and spring means carried by said socket operable to engage second and third pockets to bias said socket toward said neutral position.

2. The razor of claim 1 in which the socket defines a body and a cap permanently latched to said body, said thrust bearing element being cast integrally with said cap to define a single piece-part.

3. The razor of claim 1 in which the socket is pivotal through arcs on opposite sides of a neutral position and said spring means defines at least one leaf spring carried by said socket projecting generally parallel to said axis, said leaf spring having an operating pin cooperating with a bearing surface of a second pocket operable to urge said socket from one limit of one arc toward said neutral position.

4. The razor of claim 3 in which said spring means defines two parallel leaf springs each having an operating pin individual to a bearing surface in second and third pockets, respectively, and each spring being operable individually to urge said socket from limits of opposed arcs toward said neutral position.

5. The razor of claim 4 in which the leaf springs are cast integrally with said socket body to define with said body a single piece-part.

6. The razor of claim 5 in which the leaf springs are supported at opposed ends of said socket body and the springs are offset from one another in a direction normal to said axis.

7. The razor of claim 6 in which one end of each leaf spring is anchored to said socket body and the opposite end of each spring is unsupported and terminates in an operating pin.

8. The razor of claim 2 in which the socket body is formed with a through opening, a portion of whose periphery defines a locking ledge, and said cap is received within said opening and is formed with at least one flexible finger terminating in a claw operable to engage the ledge to latch the cap to the body.

9. The razor of claim 8 in which the cap and body are formed with cooperating shoulders for limiting the entry of the cap into the opening.

10. The razor of claim 9 in which the opening and the cap are both of generally rectangular configuration and the cap is formed with opposed flexible fingers each terminating in a claw cooperating with mating opposed locking ledges for effecting the latching function.

11. The razor of claim 10 in which the opposed fingers are arranged in pairs and a first pair of fingers straddle a first leaf spring and a second pair of fingers straddle a second leaf spring.

12. The razor of claim 11 in which the fingers and the periphery of the through opening are formed with cooperating cam surfaces to facilitate assembling the socket cap to the socket body.

13. The razor of claim 3 in which the blade cartridge is formed with a channel which engages a mating track formed on the socket body, said channel being formed with a recess, a portion of said track defining a flexible web supporting a button, said track, web and button all cast integrally with said socket body to create a single piece-part, and said button cooperating with said recess to latch the blade cartridge in proper position relative to said socket body.

* * * * *

UNITED STATES PATENT AND TRADEMARK OFFICE

CERTIFICATE OF CORRECTION

PATENT NO. : 4,403,414

DATED : September 13, 1983

INVENTOR(S) : ERNEST F. KIRALY and ERNEST A. ORTIZ

It is certified that error appears in the above-identified patent and that said Letters Patent are hereby corrected as shown below:

Column 5, line 6, "pivot side" should be --pivot axis--.

Signed and Sealed this

*Twentieth* Day of *December 1983*

[SEAL]

*Attest:*

GERALD J. MOSSINGHOFF

*Attesting Officer*

*Commissioner of Patents and Trademarks*